US006457904B2

(12) United States Patent
Bishop et al.

(10) Patent No.: US 6,457,904 B2
(45) Date of Patent: Oct. 1, 2002

(54) BOAT LIFT APPARATUS

(76) Inventors: Richard B. Bishop, 4734 Starboard Dr., Bradenton, FL (US) 34208; Charles L. Bishop, 1301 Countryside Manor Ct., Chesterfield, MO (US) 63005

( * ) Notice: Subject to any disclaimer, the term of this patent is extended or adjusted under 35 U.S.C. 154(b) by 0 days.

(21) Appl. No.: 09/760,533

(22) Filed: Jan. 16, 2001

Related U.S. Application Data

(63) Continuation-in-part of application No. 09/371,321, filed on Aug. 10, 1999, now Pat. No. 6,174,106, which is a continuation of application No. 09/205,862, filed on Dec. 4, 1998, now Pat. No. 5,947,639.

(60) Provisional application No. 06/070,518, filed on Jan. 6, 1998.

(51) Int. Cl.[7] ..... B63C 13/00

(52) U.S. Cl. ..... 405/3; 212/330; 414/459

(58) Field of Search ..... 414/459, 460; 212/328, 330; 405/1, 3, 86; 114/263, 44

(56) References Cited

U.S. PATENT DOCUMENTS

| | | | | |
|---|---|---|---|---|
| 728,117 | A | | 5/1903 | Kirsch et al. |
| 850,320 | A | | 4/1907 | Roeder |
| 1,283,744 | A | | 11/1918 | Haalck |
| 3,047,159 | A | | 7/1962 | Hurst et al. |
| 3,043,444 | A | | 11/1962 | Melton |
| 3,101,149 | A | | 8/1963 | Hurst |
| 3,177,668 | A | * | 4/1965 | Schneider et al. |
| 3,252,589 | A | | 5/1966 | Keene et al. |
| 3,409,153 | A | | 11/1968 | Stearn et al. |
| 4,106,641 | A | | 8/1978 | Campbell et al. |
| 4,109,896 | A | * | 8/1978 | Ragen ..... 254/144 |
| 4,190,013 | A | | 2/1980 | Otis et al. |
| 4,236,859 | A | * | 12/1980 | Stearn et al. ..... 414/460 |
| 4,433,952 | A | | 2/1984 | Glickman |
| 4,662,300 | A | | 5/1987 | McCallum et al. |
| 4,861,218 | A | * | 8/1989 | Lamer ..... 414/461 |
| 5,037,237 | A | | 8/1991 | Anteau |
| 5,184,914 | A | | 2/1993 | Basta |
| 5,257,891 | A | | 11/1993 | Baumann et al. |
| 5,593,247 | A | | 1/1997 | Endres et al. |
| 5,709,501 | A | | 1/1998 | Elbers |
| 5,826,734 | A | | 10/1998 | Baumann et al. |
| 5,947,639 | A | * | 9/1999 | Bishop et al. ..... 405/3 |
| 6,174,106 | B1 | * | 1/2001 | Bishop et al. ..... 405/3 |

* cited by examiner

*Primary Examiner*—Sherman Basinger
(74) *Attorney, Agent, or Firm*—Hahn Loeser & Parks; Michael H. Minns

(57) ABSTRACT

The present invention relates to a stationary boat lift in which a boat is able to enter and exit with little difficulty. The boat lift allows a boat to bypass various barriers in a efficient and safe manner by vertically lifting the boat out of one body of water, translating the boat horizontally over a desired barrier, and then vertically lowering the boat into a second body of water.

16 Claims, 4 Drawing Sheets

BOAT LIFT APPARATUS

This application is a continuation-in-part of prior application Ser. No. 09/371,321, filed Aug. 10, 1999, now U.S. Pat. No. 6,174,106, which was a continuation of prior application Ser. No. 09/205,862, filled Dec. 4, 1998, now U.S. Pat. No. 5,947,639. This application claims the benefit of U.S. Provisional application No. 60/070,518 filed Jan. 6, 1998. application Ser. Nos. 09/371,321 09/205,862, and 60/070,518 are hereby incorporated by reference.

BACKGROUND OF THE INVENTION

The present invention relates to a lifting apparatus used to portage a boat. More specifically, the present invention relates to a mechanism for vertically lifting a boat out of one body of water, transferring the boat horizontally over a barrier, and then vertically lowering the boat into a second body of water.

Known within the prior art are devices for lifting boats out of water for such purposes as making repairs, protecting boats from dock collision caused by tidal action, and preventing damage to a boat's hull from excessive exposure to water. U.S. Pat. No. 5,184,914, describes and shows a boat lift that consists of a frame which cradles and lifts a boat from the water by the means of a hydraulic ram. The device requires a person to enter the water to secure several members of the device around the bottom of the hull. U.S. Pat. No. 5,593,247 describes a programmable boat lift control system that with the push of a button, the lift may either raise or lower the boat to a pre-programmed elevation.

Both of these devices are useful for lifting boats out of water, but are both limited to lifting and lowering the boat in a vertical direction which is indicative of the general state of the art in boat lifting devices. The prior art fails to teach an apparatus that can both, lift and lower a boat in a vertical direction and transfer the boat in a horizontal direction. Applicant has discovered the need to transfer boats over barriers, such as water divider walls. In many areas salt water and fresh water are separated by various types of barriers. Barriers are needed to separate fresh water from salt water due to the various types of organisms, plants and animals which can only survive in either salt or fresh water, but not both. Regardless of the need to isolate salt from fresh water, boats and other types of water vehicles still require access to and from these separate bodies of water.

The foregoing illustrates limitations known to exist in present boat lift apparatuses. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a boat lift apparatus comprising: a moveable hoist assembly erected over a barrier separating a first body of water and a second body of water, the hoist assembly including a moveable lift frame and a load distribution subassembly connected to the lift frame, wherein the load distribution subassembly includes a pair of load distribution supports extending longitudinally and spaced laterally relative to one another and a cradle connected between the load distribution supports and capable of receiving a boat to be carried across the barrier by the apparatus; a mechanism for raising and lowering the lift frame; and a mechanism for conveying the hoist assembly between a first position over the first body of water to a second position over the second body of water.

After the boat has entered the lift it is positioned over a pair of slings which are placed under the boat. One sling is located near the bow or front portion of the boat while the second sling is located near the stern or rear portion of the boat. The slings are fastened to a lift frame which is lowered or raised by hydraulic power.

Once the boat is in a fully raised position, the boat lift translates the boat in a horizontal direction over the particular barrier. Translation of the hoist is controlled by a motor which powers a set of flanged wheels to move the boat lift back and fourth in a horizontal direction. An operator is able to easily control the functioning of the boat lift through a control panel located near or within the boat lift.

It is therefore an object of the present invention to provide a new and improved boat lift capable of lifting a boat in and out of water in both a vertical and horizontal direction.

It is a further object of the present invention to provide a boat lift which can be easily and safely operated by one or more individuals, who are operators of the boat and not require an operator full time for the boat lift.

It is still a further object of the present invention to provide a boat lift which allows a boat to be lifted and carried over various types of barriers.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 2:
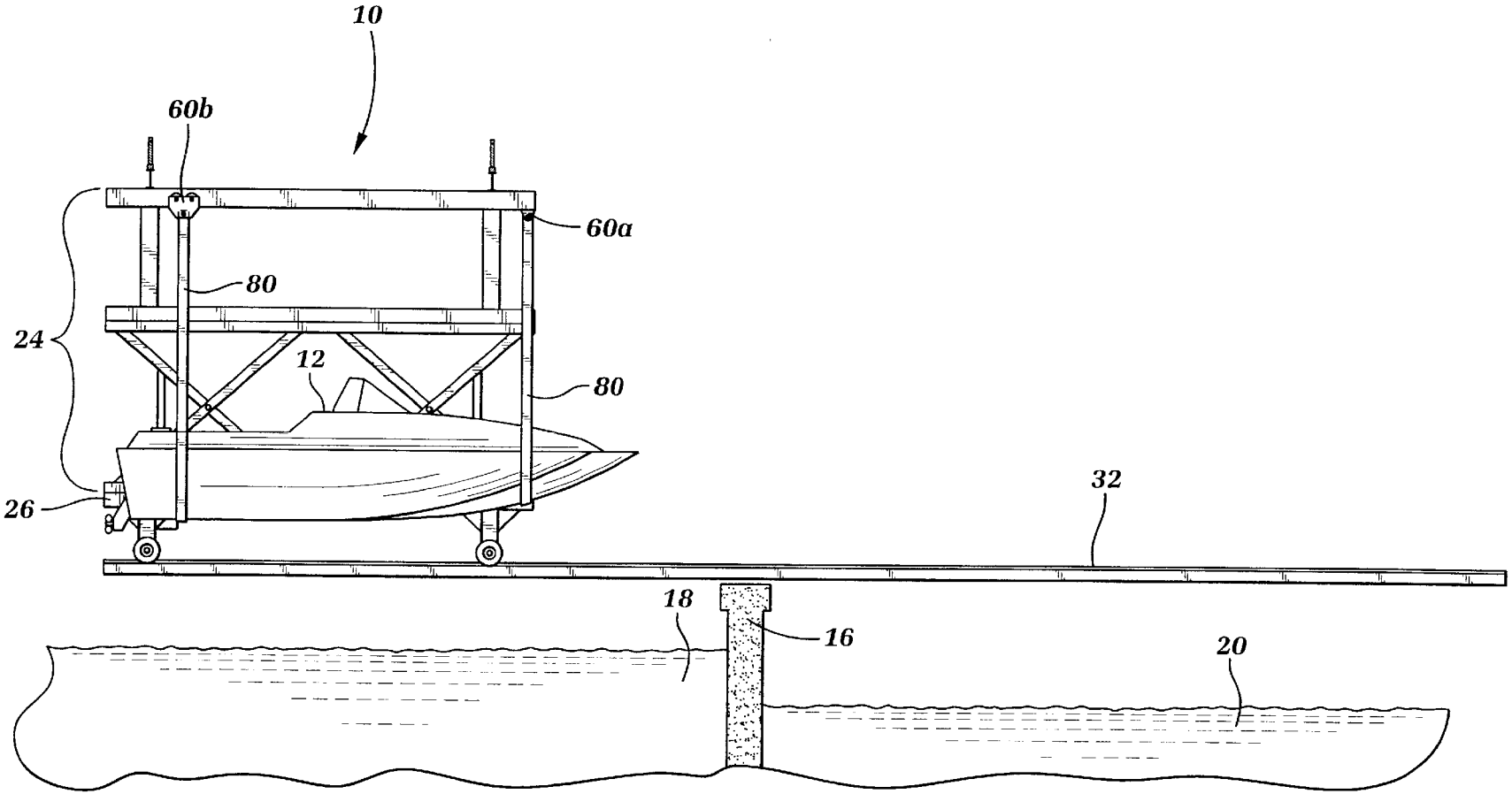
FIG. 2 is a side elevation view of the boat lift apparatus shown in FIG. 1 as the boat initially enters the boat lift apparatus.

In the following description of a preferred embodiment of the present invention, reference is made to the accompanying drawings which, in conjunction with this detailed description, illustrate and describe a boat lift capable of hoisting a boat out of one body of water, translating the boat in a horizontal direction over a barrier and then lowering the boat into a second body of water. Referring to FIG. 2, boat lift 10 consists of vertically moveable lift frame 24 mounted on a horizontally moveable lift frame support bed 26 which rolls on tracks 32 which are placed alongside a first body of water 18 and a second body of water 20 divided by barrier 16. Many areas having both salt and fresh water bodies must take care not to allow the two bodies of water to mix thereby contaminating the fresh water. Various types of organisms, plants and animals can only survive in either salt water or fresh water. To accomplish this many communities construct barriers separating the two bodies of water. The down side to using barriers is that boats are prevented from freely traveling between the fresh and salt water bodies.

Figure 1:
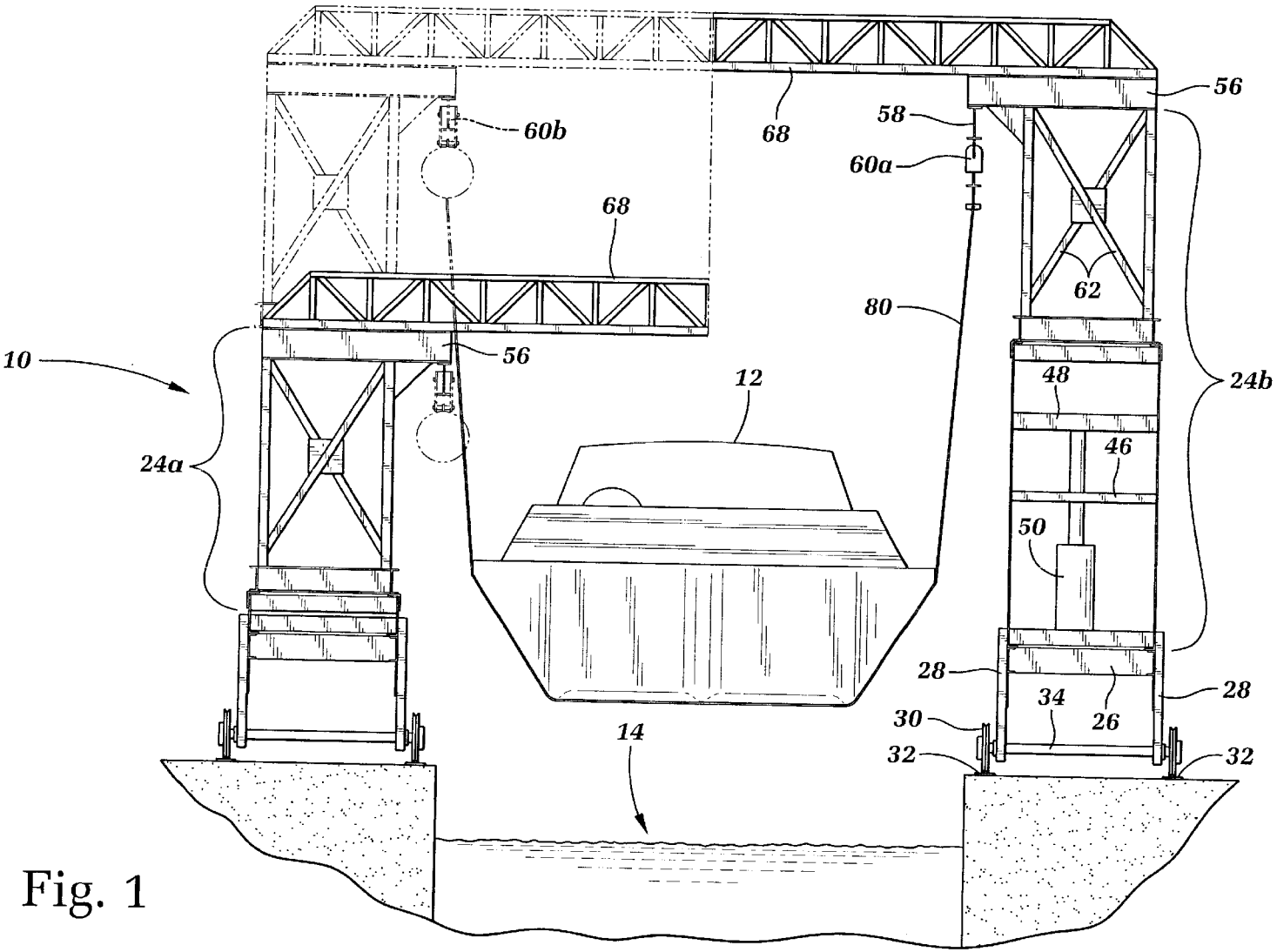
FIG. 1 is a front elevational view of the boat lift apparatus of the present invention.

In FIG. 1, boat 12 enters boat lift 10 at either one of two ends via either first body of water 18 or second body of water 20. Channel 14 of boat lift 10 is divided into two sections by barrier 16. Barrier 16 is located between and divides the first and second bodies of water, 18 and 20 respectively, at approximately the middle of the channel 14 effectively creating two isolated bodies of water.

Figure 3:
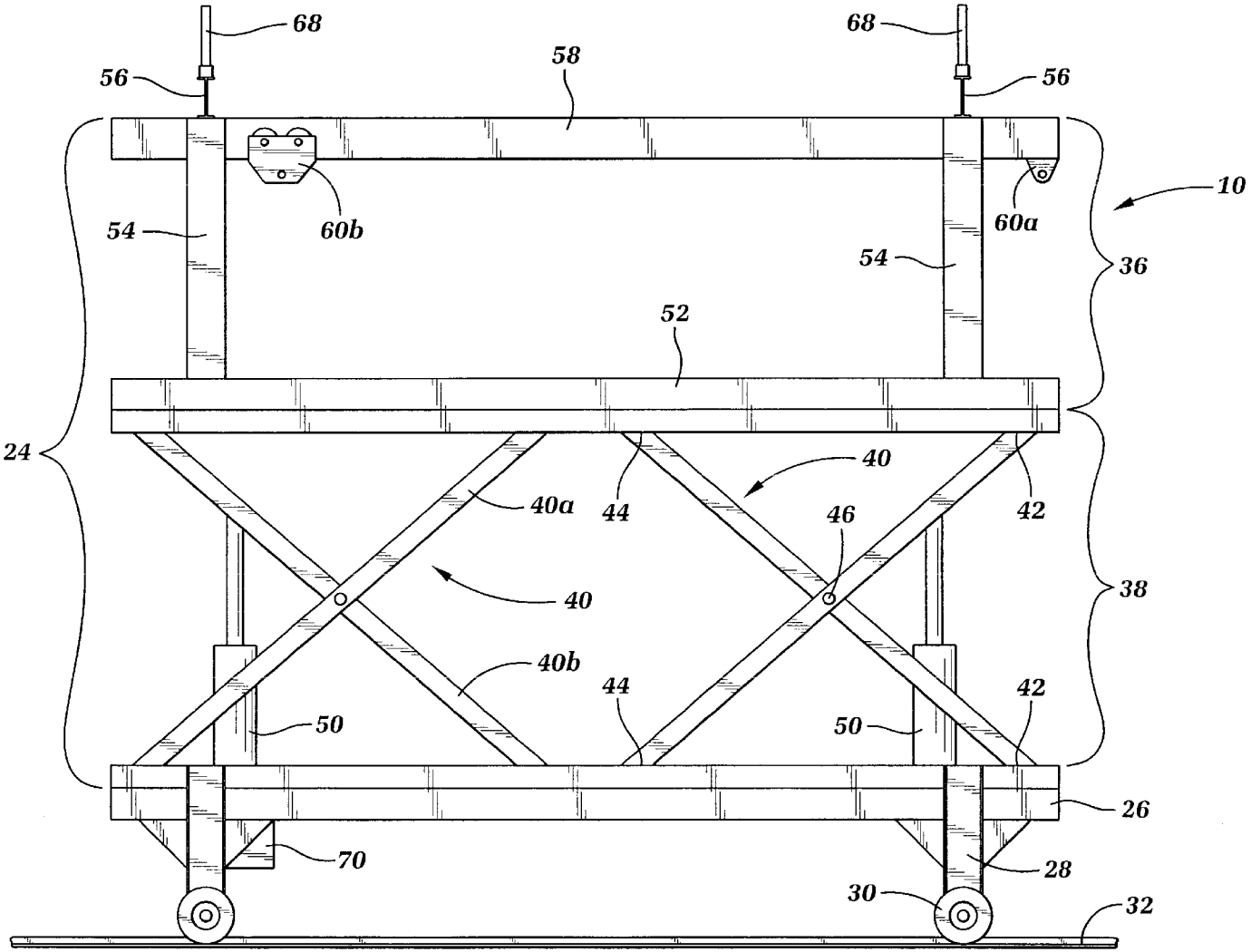
FIG. 3 is a side elevation view of a first embodiment of the lift frame of the boat apparatus shown in FIG. 1.

The vertically moveable lift frame 24 consists of two sub-frames 24*a*, 24*b*, one on each side of channel 14. As shown in FIG. 3, each lift sub-frame 24*a*, 24*b* consists of two sections, an upper platform 36 and a lower scissors platform 38. The upper platform 36 includes a lower beam 52 attached to upper beams 56 by a plurality of fixed supports 54. On the inner (or channel side) side of each lift sub-frame 24*a*, 24*b*, a load distribution subassembly 58 is attached to the upper beams 56. A cradle 80 is attached to the load distribution subassemblies 58 at cradle connectors 60. Preferably one connector 60*a* is a fixed connection and the other connector 60*b* is slideable along load distribution subassembly 58. Lift sub-frames 24*a*, 24*b* are connected to one another by transversely extending trusses 68 which span channel 14. Trusses 68 are connected to upper beams 56. To accommodate varying loads, ground settlement and other alignment problems, trusses 68 may be fixed to one lift sub-frame 24*a* and slidingly connected to the other lift sub-frame 24*b* to allow for movement of the tops of the lift subframes 24*a*, 24*b* towards or away from each other. To provide additional support and stiffness to the upper platform, cross supports 62 can be provided. The load distribution subassemblies 58 can be omitted and cradle 80 can be attached to other portions of upper platform 36.

Preferably, cradle 80 is a pair of slings, as shown in the figures. Slings 80, preferably, are fabricated from high strength polyester which is resistant to damage t- from abrasion and deterioration from exposure to water, particularly salt water. The slings 80 may also be fabricated materials offering similar damage resistance, such as nylon and the like. It is also possible that the cradle for carrying boat 12 may be comprised of other suitable means, including but not limited to, a heavy gauge net which may be coupled at its extremities to connectors 60*a*, 60*b*. Like the slings 80, such net may also be produced from high strength polyester or nylon. In order that the slings 80, or alternatively a net, will readily submerge rather than float, lead weights are provided with the slings 80 arid the net. In the case of the slings 80, the lead weights are sewn into packets provided in the slings 80. Preferably cradle 80 is does not retain any water around the boat 12 when the boat 12 is lifted out of the water.

The lower scissors platform 38 consists of a lift frame support bed 26 connected to upper platform lower beam 52 by double scissors mechanisms 40. The lift frame support bed 26 has a plurality of support legs 28 attached thereto with wheels 30 attached to axles 34, at the lower ends thereof. The wheels 30 engage a track 32 which extends along the channel 14 on both sides of the channel 14. The wheels 30 and track 32 permit the boat lift 10 to move horizontally along the channel 14 to transport a boat 12 over the barrier 16 from the first body of water 18 to the second body of water 20 or vice versa. A transit motor 70 is attached to a lower side of the lift frame support bed 26. The transit motor 70 preferably drives one set of wheels 30 through a chain and sprocket (not shown).

The scissors mechanisms 40 each consist of two scissors legs 40*a*, 40*b*, pivotally connected by scissors connector 46. One end 42 of each scissors mechanism legs 40*a*, 40*b* is fixed to the lower scissors platform 38. The other end 44 slides along either an upper surface of lift frame support bed 26 or a lower surface of upper platform lower beam 52. Upper hydraulic cylinder beams 48 are provided between scissors legs 40*a*, 40*b* (See FIG. 1). Hydraulic cylinders are connected between the lift frame support bed 26 and the upper hydraulic cylinder beams 48. The left side of FIG. 1 illustrates the lift frame 24 when the hydraulic cylinders 50 are retracted and the lift frame 24 is in its lower position. The left side of FIG. 1 also illustrates the left sling position (shown in FIG. 2) with the slideable sling connector 60*b*. The left side of FIG. 1 shows in phantom lines the upper position of lift frame 24. The right side of FIG. 1 illustrates the lift frame 24 when the hydraulic cylinders 50 are fully extended pressing against upper hydraulic cylinder beam 48 causing the scissors mechanisms 40 to lift the upper platform 36 to a raised or upper position. In the preferred embodiment, the upper platform raises about 7 feet. A hydraulic power source (not shown) is provided on the lift frame 24. Retractable cords (not shown) are provided to provide electrical power and control signals to the transit motor 70 and the hydraulic power source. The intended maximum boat weight that boat lift 10 can lift is 20,000 lbs. By changing the strength and configurations of the structural members, the size of the hydraulic cylinders, higher boat weights can be accommodated.

Figure 4:
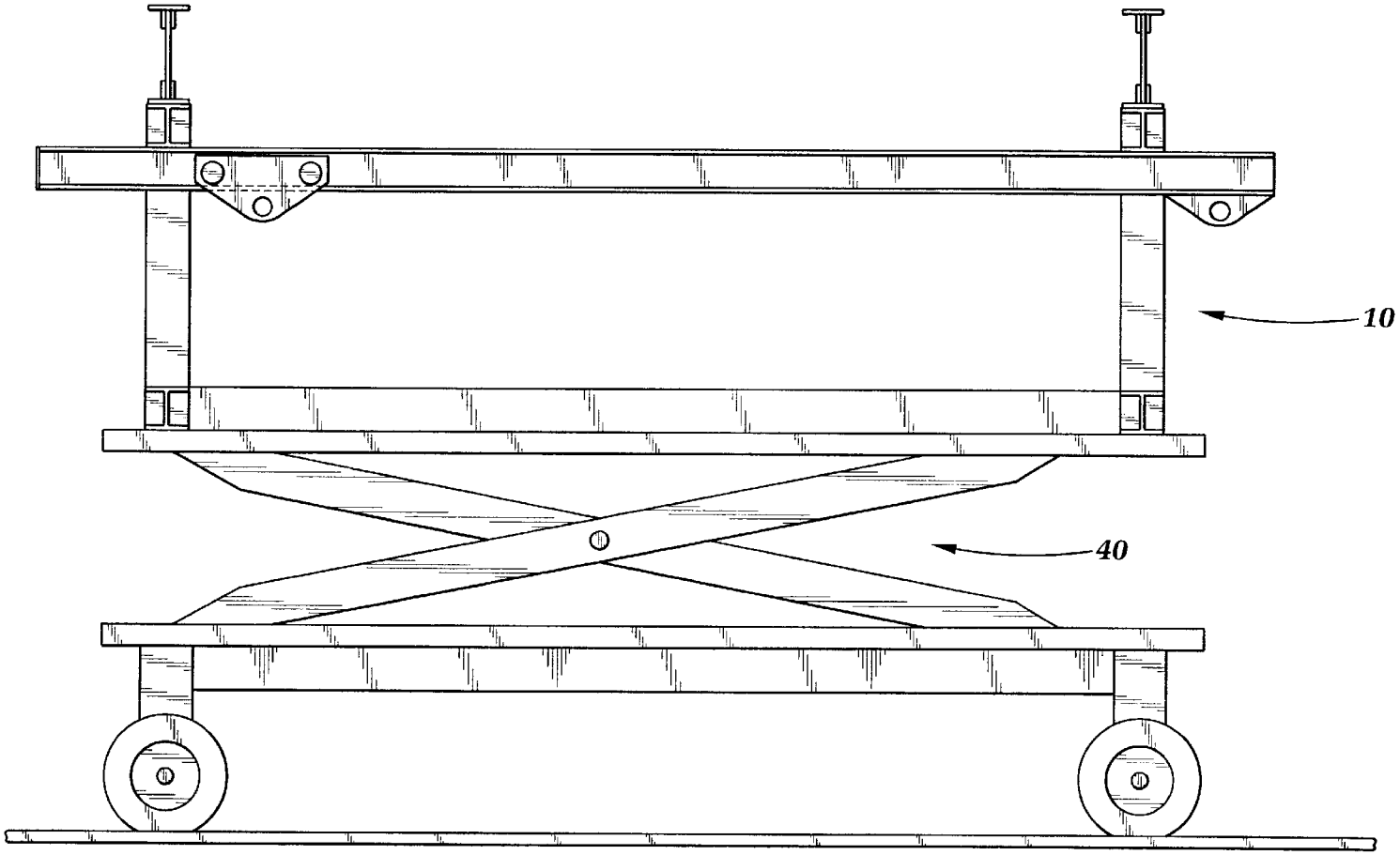
FIG. 4 is a side elevation view of a second embodiment of the lift frame of the boat apparatus shown in FIG. 1

Although the preferred embodiment shows a lift frame 24 which uses double scissors mechanisms 40, other configuration of hydraulic lifting devices may be used. One example is shown in FIG. 4 where a single scissors mechanism 40 is used for each lift sub-frame 24*a*, 24*b*. Another configuration could use multiple levels of lift frame support beds, each support bed being connected to the one above it by a set of hydraulic cylinders. The scissors mechanisms 40 or other lift multiplier mechanisms are preferred.

In use, the boat lift 10 is positioned over the first body of water 18 with the lift frame 24 in the lower position. Boat 12 is driven into channel 14 and positioned with the slings 80 about the boat 12 as shown in FIG. 2. Because of the slideable connector 60*a*, the left most sling 80 (as shown in FIG. 2) can be moved to accommodate different length boats. Hydraulic power is provided to the hydraulic cylinders 50 causing the hydraulic cylinders 50 to extend and lifting the upper platform 36, attached slings 80 and boat 12. Transit motor 70 is energized moving boat lift 10 from over the first body of water 28 over the barrier 16 and over the second body of water 20. The hydraulic power is turned off and the hydraulic pressure to the hydraulic cylinders 50 is relieved allowing the hydraulic cylinders 50 to retract, thereby lowering the upper platform 36 along with slings 80 and boat 12 to its lower most position, lowering the boat 12 into the body of water 20. The boat 12, having successfully transited barrier 16, can now be driven in the second body of water 20.

Having described the invention, what is claimed is:

1. A boat lift apparatus comprising:

a moveable hoist assembly erected over a barrier separating a first body of water and a second body of water, the hoist assembly including a moveable lift frame and a load distribution subassembly connected to the lift frame, wherein the load distribution subassembly includes a pair of load distribution supports extending longitudinally and spaced laterally relative to one another and a cradle connected between the load distribution supports and capable of receiving a boat to be carried across the barrier by the apparatus;

a hydraulically operated mechanism for raising and lowering the lift frame; and a mechanism for conveying the hoist assembly between a first position over the first body of water to a second position over the second body of water, wherein the lift frame is connected to the hoist assembly by a plurality of scissors mechanisms.

2. The boat lift apparatus according to claim 1, wherein the mechanism for raising and lowering the lift frame is a plurality of hydraulic cylinders.

3. The boat lift apparatus according to claim 2, wherein the plurality of hydraulic cylinders are positioned between a portion of the hoist assembly and the scissors mechanism.

4. The boat lift apparatus according to claim 1, wherein the lift frame comprises two laterally spaced apart lift sub-frames, a load distribution support being connect to each lift sub-frame.

5. The boat lift apparatus according to claim 1, wherein the cradle comprises at least two longitudinally spaced straps.

6. A boat lift apparatus comprising:

a moveable hoist assembly erected over a barrier separating a first body of water and a second body of water, the hoist assembly including: a vertically moveable lift frame, the lift frame comprising two laterally spaced apart lift sub-frames; a load distribution subassembly connected to the lift frame, wherein the load distribution subassembly includes a pair of load distribution supports extending longitudinally and spaced laterally relative to one another, a load distribution support being connected to each lift sub-frame; and a cradle connected between the load distribution supports and capable of receiving a boat to be carried across the barrier by the apparatus;

a mechanism for raising and lowering the lift frame; and a mechanism for conveying the hoist assembly between a first position over the first body of water to a second position over the second body of water, wherein the lift sub-frames are connected by at least one laterally extending cross support, the at least one laterally extending cross support being connected to an upper part of the lift sub-frames and being positioned above the cradle.

7. The boat lift apparatus according to claim 6, wherein the cross support is a truss.

8. A boat lift apparatus comprising:

a moveable hoist assembly erected over a barrier separating a first body of water and a second body of water, the hoist assembly including a moveable lift frame and a load distribution subassembly connected to the lift frame, wherein the load distribution subassembly includes a pair of load distribution supports extending longitudinally and spaced laterally relative to one another and a cradle connected between the load distribution supports and capable of receiving a boat to be carried across the barrier by the apparatus, the cradle comprising at least two longitudinally spaced straps;

a mechanism for raising and lowering the lift frame; and a mechanism for conveying the hoist assembly between a first position over the first body of water to a second position over the second body of water, wherein one of the at least two longitudinally spaced straps is slidingly attached to the load distribution supports.

9. A boat lift apparatus comprising:

a moveable hoist assembly erected over a barrier separating a first body of water and a second body of water, the hoist assembly including a moveable lift frame;

a non-water retaining cradle connected to the lift frame and capable of receiving a boat to be carried across the barrier by the apparatus;

a hydraulic mechanism for raising and lowering the lift frame, the hydraulic mechanism for raising and lowering the lift frame being a plurality of hydraulic cylinders; and a mechanism for conveying the hoist assembly between a first position over the first body of water to a second position over the second body of water, wherein the lift frame is connected to the hoist assembly by a plurality of scissors mechanisms.

10. The boat lift apparatus according to claim 9, wherein the plurality of hydraulic cylinders are positioned between a portion of the hoist assembly and the scissors mechanism.

11. The boat lift apparatus according to claim 9, wherein the lift frame comprises two laterally spaced apart lift sub-frames.

12. The boat lift apparatus according to claim 11, wherein the lift sub-frames are connected by at least one laterally extending cross support.

13. A boat lift apparatus comprising:

a moveable hoist assembly erected over a barrier separating a first body of water and a second body of water, the hoist assembly including a moveable lift frame;

a non-water retaining cradle connected to the lift frame and capable of receiving a boat to be carried across the barrier by the apparatus, the cradle comprising at least two longitudinally s aced straps, one of the at least two longitudinally spaced straps being slidingly attached to the lift frame;

a plurality of scissors mechanisms connected between the lift frame and the hoist assembly;

a hydraulic mechanism for raising and lowering the lift frame, the hydraulic mechanism comprising a plurality of hydraulic cylinders connected between a portion of the hoist assembly and the scissors mechanism; and a mechanism for conveying the hoist assembly between a first position over the first body of water to a second position over the second body of water.

14. A method for transporting a boat over a barrier separating a first body of water from a second body of water, the method comprising the steps of:

positioning over the first body of water a moveable hoist assembly and moveable lift frame, positioning in the first body of water a non-water retaining cradle that is connected to the lift frame, the lift frame including a pair of lift sub-frames spaced laterally relative to one another and the cradle being connected between the lift sub-frames and capable of receiving a boat to be carried across the barrier by the apparatus;

positioning the boat above the cradle;

hydraulically raising a hydraulic cylinder beam a first distance, the hydraulic cylinder beam being operatively connected to the lift frame, the lift frame and the boat being raised a second distance, the second distance being greater than the first distance, to lift the boat out of the first body of water and to an elevation that is higher than the barrier;

translating the hoist assembly along with the boat over and across the barrier;

positioning the hoist assembly and the boat over the second body of water; and hydraulically lowering the hydraulic cylinder beam, the lift frame and the boat to lower the boat into the second body of water.

15. A method according to claim 14, wherein the steps of positioning the hoist assembly over the first body of water, translating the hoist assembly along with the boat over and across the barrier, and positioning the hoist assembly and the boat over the second body of water include horizontally moving the hoist assembly.

16. A method according to claim 15, wherein the steps of positioning in the first body of water the cradle, raising the lift frame and the boat to lift the boat out of the first body of water, and lowering the lift frame and the boat to lower the boat into the second body of water include vertically moving the lift frame.

* * * * *